United States Patent [19]

Cocoros et al.

[11] 4,131,424

[45] Dec. 26, 1978

[54] METHOD OF DYEING USING THE COMBINATION OF CERTAIN HALOGENATED HYDROCARBONS AND AROMATIC SOLVENTS IN AN AQUEOUS DYE ADMIXTURE

[75] Inventors: George Cocoros, Gaffney; Thomas V. Chambers, Inman, both of S.C.; Julian J. Hirshfeld, Gastonia, N.C.

[73] Assignee: Milliken Research Corporation, Spartanburg, S.C.

[21] Appl. No.: 817,585

[22] Filed: Jul. 21, 1977

[51] Int. Cl.[2] ..... D06P 5/06; D06P 5/04; D06P 1/44; C09B 67/00

[52] U.S. Cl. ..... 8/172 R; 8/173; 8/174; 8/175; 8/92; 8/93; 8/94 A; 8/1 XB; 8/176

[58] Field of Search ..... 8/94 A, 174, 175, 92, 8/94 R, 1 XB, 173, 93, 172

[56] References Cited

U.S. PATENT DOCUMENTS

| | | | |
|---|---|---|---|
| 1,738,978 | 12/1929 | Whitehead | 8/175 |
| 2,173,178 | 9/1939 | Moncrieff et al. | 8/94 A |
| 2,182,963 | 12/1939 | Dreyfus et al. | 8/94 A |
| 2,274,751 | 2/1942 | Sowter et al. | 8/94 A |
| 3,046,076 | 7/1962 | Upshur | 8/94 |
| 3,524,718 | 8/1970 | Nador et al. | 8/94 A |
| 3,785,767 | 1/1974 | Hildebrand et al. | 8/174 |
| 3,871,898 | 3/1975 | Reinert et al. | 8/94 A |
| 3,918,902 | 11/1975 | Hoster et al. | 8/175 |

FOREIGN PATENT DOCUMENTS

| | | | |
|---|---|---|---|
| 1045839 | 10/1966 | United Kingdom | 8/94 A |
| 1103860 | 2/1968 | United Kingdom | 8/94 A |
| 1127967 | 9/1968 | United Kingdom | 8/94 A |
| 1153221 | 5/1969 | United Kingdom | 8/94 A |

OTHER PUBLICATIONS

Dodd, G. S. et al., Jour. Soc. of Dyes & Colorists, Mar. 1977, pp. 74–82.

CIBA Review Jan. 1967, pp. 47–58.

*Primary Examiner*—Melvyn I. Marquis
*Assistant Examiner*—Maria S. Tungol
*Attorney, Agent, or Firm*—Robert S. Alexander; H. William Petry

[57] ABSTRACT

A method of dyeing synthetic fibers, especially polyester and acrylic using an aqueous dyeing admixture containing a halogenated hydrocarbon solvent, an aromatic carrier, an emulsifier and a dyestuff.

17 Claims, No Drawings

METHOD OF DYEING USING THE COMBINATION OF CERTAIN HALOGENATED HYDROCARBONS AND AROMATIC SOLVENTS IN AN AQUEOUS DYE ADMIXTURE

Dyers are among the most conservative of people and for good reason, often the slightest change in a process has drastic and unpredictable results. Further, dyers have long followed the precept, "If you can do without it, leave it out." Thus, while it has been well known to use aromatic carriers in dyeing, and while the use of aliphatic halogenated hydrocarbons in various aspects of the dyeing procedure has been known, it has not been known that significant advantages in the dyeing of synthetic fibers could be obtained by including a mixture of an aromatic carrier and a halogenated hydrocarbon chosen from the group consisting of methylene chloride, chloroform, perchloroethylene and 1,2 dichloroethane in an aqueous dyeing admixture. In particular, it has been found that it is possible to obtain dyeings of polyester and acrylic fibers which are equivalent to those known to the prior art at temperatures which are significantly lower than those used in the prior art while using dye cycles of shorter duration. It is found that the most significantly improved results are obtained when polyester fibers are dyed using disperse dyes and acrylic fibers are dyed using basic dyes in accordance with the method of the present invention.

SUMMARY OF THE INVENTION

An object of the invention is to provide a dyeing method which permits low temperature dyeing of synthetic fibers in relatively short processing times. Other objects and advantages of the present invention will be apparent to those skilled in the art. According to the present invention, fabrics are dyed by contacting the fibers with an aqueous dyeing admixture including an organic dyeing composition dispersed in an aqueous phase, wherein the organic dyeing composition includes: emulsifier, dyestuff, halogenated hydrocarbon solvent chosen from the group consisting of perchloroethylene, methylene chloride, chloroform and 1,2 dichloroethane and aromatic carrier. Afterwards the dye is fixed by conventional procedures, the fabric washed, dried and recovered.

DESCRIPTION OF THE PREFERRED EMBODIMENT

The method of the present invention can be used on any fiber; however, it provides the most significant improvement when used with synthetic fibers, especially polyester and acrylic.

The dyeing formulation of the present invention has been found to be especially useful for continuous dyeing of carpets containing polyester, package dyeing of polyester or acrylic yarn and jet dyeing of fabrics containing polyester or acrylic.

INJECTION DYEING OF CARPETS

The method of the present invention has been found to be particularly useful for injection dyeing of polyester carpets wherein dyeing formulation is injected into the pile by jets. In particular, it has been found that carpets having a polyester pile may be injection dyed to very deep colors using the dyeing formulation of the present invention. Previously, injection dyeing has not been a commercially practicable method of dyeing polyester carpet because it has not been possible to obtain satisfactory depth of color or to obtain suitable colorfastness.

The viscosity of the dyeing formulations which are suitable for injection dyeing vary widely. If patterns are to be dyed, it is desirable that the viscosity be high enough to prevent excessive migration of the dyestuff through the carpet while not being so excessive as to hinder application. In most cases, it is advantageous to maintain the viscosity of the dyeing formulation above about 100 centipoise. However, lower viscosities may be used if the resulting migration can be tolerated. When it is desirable to increase the viscosity of the dyeing formulation, any suitable thickener can be used provided that it does not interfere with the dyeing procedure and is easily removed.

Suitable thickeners include the compounds which are commonly called anti-migrants and are divided into natural thickeners and synthetic thickeners, both of which can be used. Natural thickeners include gums, the extract of locust beans, starches, gum arabic, guar gum, alginates and the like. Synthetic thickeners include polyacrylic acids, ethylene maleic anhydride and the like. Polyacrylic acids and alginates are also commonly used as antimigrating compounds.

The halogenated hydrocarbon compounds which are suitable for the dyeing of polyester carpets include methylene chloride, chloroform, 1,2 dichloroethane, perchloroethylene and mixtures thereof.

Suitable aromatic carriers for the dyeing of polyester carpets include those compounds having the structural formula

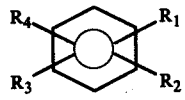

or

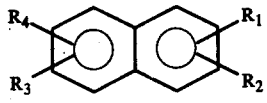

wherein $R_1$, $R_2$, $R_3$ and $R_4$ are each selected independently from the group consisting of hydrogen, an alkyl group having from 1-5 carbon atoms, a halogen, a hydroxyl group, a phenyl group, a $$-\overset{O}{\overset{\|}{C}}-C-C_nH_{2n+1}$$

group with n=1−3, a $$C_nH_{2n+1}-O-\overset{O}{\overset{\|}{C}}-CH_2$$

group with n=1−3, a benzyl group, a phenethyl group, or an $-NO_x$ group with x=1−3 and at least one $R_{1-4}$ is a moiety other than hydrogen. Mixtures of these compounds are also suitable. Of these compounds beta-naphthol, methyl naphthalene and the benzene derivatives are preferred and still more preferred are methyl naphthalene, beta-naphthol and the compounds having the structural formula

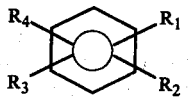

wherein $R_1$, $R_2$, $R_3$ and $R_4$ are each selected independently from the group consisting of hydrogen, a halogen, an alkyl group having from 1 to 5 carbon atoms, a hydroxyl group, a phenyl group or a $$-\overset{\overset{\displaystyle O}{\|}}{C}-O-C_nH_{2n+1}$$

group with n=1−3 and at least one $R_{1-4}$ is a moiety other than hydrogen.

Of the benzene derivatives, the following have been found to be particularly useful: para-chloro ortho-benzyl phenol, methyl benzoate, biphenyl and trichlorobenzene. Of these, methyl benzoate is the preferred aromatic carrier because it is biodegradable. Crude methyl benzoate which is a by-product of polyester manufacture is suitable for use in the present invention. Of the naphthalene derivatives, beta-naphthol and methyl naphthalene are particularly suitable for use in the continuous dyeing of polyester carpets. Mixtures of any of the above benzene and naphthalene derivatives can also be used.

The most preferred aromatic carrier for continuous dyeing of polyester carpets is methyl benzoate and the most preferred halogenated hydrocarbon solvent is methylene chloride.

For continuous dyeing of polyester carpets, a suitable dyeing admixture is as follows: the organic phase of the dyeing admixture is from about 1% to about 65% of the total mixture. Of the organic phase, from about 40% to about 98% is one of the halogenated hydrocarbons or a mixture of the halogenated hydrocarbons and from about 1% to about 60% is an aromatic carrier or a mixture of the aromatic carriers. An emulsifier should be included in an amount which is effective to disperse the organic phase in the aqueous phase, the amount required may vary widely depending upon the composition to be dispersed and the conditions to be employed in dyeing. However, desirable results can be obtained when the amount of emulsifier is between 1% and 30% of the organic phase. Similarly, sufficient thickener should be included to yield the desired viscosity, the amount required may vary widely but desirable results can be obtained when the organic phase is from about 1% to about 10% thickener. The amount of dyestuff is determined by the depth of color desired and so also may vary widely; an amount of dyestuff which is effective to obtain the desired depth of color should be included but the amount included will usually be from about 0.001% to about 6% of the total organic phase.

Compounds which are useful in dispersing organic liquids in an aqueous phase are well known to the prior art and many of the emulsifiers which are commonly used for dispersing aromatic carriers in an aqueous phase are also suitable for dispersing mixtures of halogenated hydrocarbons and aromatic carriers in water. Typical of these are the isopropylamine salts of dodecylbenzene sulfonic acid, mixtures of highly ethyoxylated nonyl phenols and calcium dodecylbenzene sulfonic acid and similar compounds.

Desirable results have been obtained when the organic phase of the dyeing admixture is from about 5% to about 30% of the total admixture and of the organic phase from about 60% to about 95% is one of the halogenated hydrocarbons or a mixture of the halogenated hydrocarbons and from about 5% to about 40% is one of the preferred aromatic carriers or a mixture of the preferred aromatic carriers.

For the dyeing of polyester carpets, the most preferred method of application is injection dyeing in which the dyeing admixture is injected into the carpet from a series of jets. The dye may also be applied by padding from a Kuster or other similar pad. In this case, the viscosity is not as critical as in injection dyeing and may vary widely. Preferably, the viscosity will be from about 10 to about 100 centipoise and more preferably will be from about 25 to about 50 centipoise.

After application, the dye should be fixed. Fixing may be accomplished by any conventional method such as atmospheric steaming, pressure steaming. Thermosoling or other well known heating methods; however, the extreme temperatures usually associated with Thermosoling are not necessary; however, if atmospheric steaming is chosen as the method of fixing the dye, then the suitable halogenated hydrocarbons do not include perchloroethylene. When polyester fibers are treated with an aqueous dyeing formulation containing perchloroethylene and an aromatic carrier, it is found that this combination does not allow the dye to be fixed by atmospheric steaming for reasons which are not entirely clear.

For reasons of economy and ease of operation, atmospheric steaming is the most preferred method of fixing the dyestuff. For most polyester fibers and most dyestuffs, steaming for between 6–10 minutes is sufficient. In exceptional cases, times up to 20 minutes may be required. After the dye is fixed, the carpets may be rinsed and dried.

PRESSURE DYEING

The dyeing formulation of the present invention has also been found to be especially advantageous for dyeing in pressurized containers. As used in this application, the term "pressure dyeing" is to be understood to encompass all methods of dyeing which utilize pressures which are above atmospheric. It specifically includes jet dyeing, beck dyeing, beam dyeing, package dyeing and skein dyeing. For the dyeing of the yarn, the preferred method of dyeing is package dyeing in which the yarn is wound onto hollow perforated cores and dyeing formulation is forced through the yarn under pressure. For the dyeing of fabrics, the preferred method of dyeing is jet dyeing in which the fabric is twisted into a rope and circulated through the dyeing formulation in a so-called "jet machine" under pressure.

The halogenated hydrocarbons which are suitable for use in pressure dyeing include methylene chloride, chloroform, perchloroethylene and 1,2 dichloroethane.

The aromatic carriers which are suitable for use in pressurized dyeing are chosen from the group consisting of: those benzene derivative compounds having the structural formula

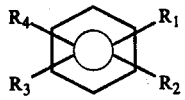

those naphthalene derivative compounds having the following structural formula

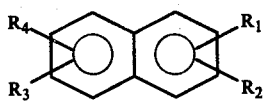

wherein each $R_{1-4}$ is individually selected from the group consisting of: a hydrogen, an alkyl group having from 1-5 carbon atoms, a halogen, a hydroxyl group, a phenyl group, $$a-\overset{\overset{\displaystyle O}{\|}}{C}-O-C_nH_{2n+1}$$

group with n=1−5, a $$C_nH_{2n+1}-O-\overset{\overset{\displaystyle O}{\|}}{C}-CH_2-$$

group with n=1−5, a benzyl group, phenethyl group, or an $-NO_x$ group with x=1−3, wherein at least one $R_{1-4}$ is a moiety other than hydrogen and mixtures of these benzene derivatives and naphthalene derivatives.

The prior art pressurized processes for polyester are generally carried out at temperatures around 280° F. Using the dyeing formulation of the present invention, it is possible to obtain equivalent results on polyester at lower temperatures, generally around 200° F. to 230° F. depending principally upon the amount of dyeing formulation used.

The prior art pressurized processes for acrylic are generally carried out at temperatures around 230° F. Using the dyeing formulation of the present invention, it is possible to obtain equivalent results on acrylic fibers at temperatures of around 170° F. to 200° F., again, depending principally upon the amount of carrier used.

The procedures employed in pressure dyeing fibers using the dyeing formulation of the present invention are similar to the procedures used in the prior art except that it is possible to use lower temperatures and shorter times are used than in the prior art and the method of introducing the dyeing formulation should be modified in jet and beck dyeing.

When the method of the present invention is used in dyeing of textiles, particularly polyester or acrylic fibers in a conventional jet or beck dyeing machine, the procedure used should be modified to minimize spotting and staining on the surface of the fabrics. The procedure used is that the aqueous dyeing formulation including dyestuff and an effective amount of an emulsifier to suspend the dyestuff but, excluding the halogenated hydrocarbon and the aromatic carrier, is first added to the mixing tank and introduced into the dyeing chamber as in conventional jet dyeing. The chamber is sealed. The temperature of the fluid inside the dyeing chamber is then raised to above the boiling point of the halogenated hydrocarbon solvent at the pressure of the chamber. The mixture of the halogenated hydrocarbon and the aromatic carrier is then introduced into the mixing tank, introduced into the machine and the machine is pressurized. If additional emulsifier is needed to disperse the aromatic carrier and the halogenated hydrocarbon, it may be introduced with them. The temperature of the mixture in the machine is raised as in conventional dyeing procedures to the holding temperature. Further in jet or beck dyeing, a defoaming agent is often desirable to prevent excessive accumulation of froth or foam in the machine. Such defoaming agents are well known and include such compositions as Warco 521 sold by Sun Chemicals, NoFom M sold by Tanatex Chemicals and Hipochem DF-2 sold by High Point Chemicals.

The holding temperature at which pressurized dyeing takes place depends principally upon the nature of the fiber and the mixture of the halogenated hydrocarbon and aromatic carrier used. The prior art processes for dyeing polyester under pressure typically use holding temperatures of around 280° F. for at least about 30 minutes for light shades and at least about 1 hour for darker shades. The amount of the mixture of halogenated hydrocarbon and aromatic carrier which may be used may vary widely depending upon the temperature but desirable results can be obtained if the amount of the mixture is between about 1% and 40% based on the dry weight of the fibers to be dyed. However, especially desirable results have been obtained when the amount of the mixture used is between about 2% and about 20% based on the dry weight of the fibers. Using the dyeing formulation of the present invention for comparable times, temperatures as low as about 200° F. may be used for the pressure dyeing of polyester but approximately 20% based on the weight of the fabric of the mixture of the halogenated hydrocarbon and aromatic carrier should be used; if, for reasons of economy, the temperature is increased to about 230° F., the amount of the mixture may be reduced to about 4 to 6% based on the weight of the fabric.

In the package dyeing of acrylic, the fibers can be dyed at 172° F. if the amount of the mixture of the halogenated hydrocarbon and aromatic carrier used is approximately 20% of the weight of the fabric; however, by increasing the temperature from 172° F. to 195° F., the amount of the mixture which should be used may be decreased to 4 to 6% based on the weight of the dry fabric. In the methods of the prior art for the package dyeing of acrylic, the typical temperature used has been around 230° F.

Suitable aqueous dyeing admixtures for pressure dyeing include from about 0.5% to about 20% of an organic phase which includes from about 40% to about 98% of one of the suitable halogenated hydrocarbons and from about 1% to about 60% of one of the suitable aromatic carriers. Advantageously, the pH of the aqueous dyeing admixture will be adjusted to between about 3 and about 7. An emulsifier should be included in an amount sufficient to disperse the organic phase in the aqueous phase, the amount of emulsifier required may vary widely depending upon the composition to be dispersed, but desirable results have been obtained when the emulsifier is between about 1% and about 10% of the organic phase. The amount of dyestuff which should be included depends primarily upon the depth of color to which the fibers are to be dyed; desirable results can be obtained when the dyestuff is from about 0.001% to about 20% of the organic phase.

The preferred aromatic carriers are those benzene derivatives having the structural formula:

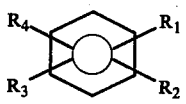

wherein each $R_{1-4}$ independently is a hydrogen, an alkyl group having from 1-5 carbon atoms, a halogen, a hydroxyl group, a phenyl group, a $$-O-\overset{O}{\overset{\|}{C}}-CH_2$$

group with n=1−5, a benzyl group, phenethyl group or an $-NO_x$ group with x=1−3, wherein at least one $R_{1-4}$ is a moiety other than hydrogen and mixtures of these benzene derivatives.

The preferred aqueous dyeing admixture includes from about 3% to about 20% of an organic phase of which from about 60% to about 98% of one of the halogenated hydrocabon compounds and from about 1% to about 40% of one of the preferred aromatic carriers. The pH of the preferred dyeing admixture will be adjusted to between about 4 and about 6.

For pressure dyeing, the most preferred aromatic carrier is methyl benzoate and the most preferred halogenated hydrocarbon solvent is methylene chloride.

Conveniently, when any of the pressure dyeing machines are depressurized, the gases may be vented through a cooling means to enable the halogenated hydrocarbon to be recovered. By this means, most of the halogenated hydrocarbon which does not remain in the fabric can be recycled. However, recovery of perchloroethylene in this manner is not possible unless the temperature at the time of depressurization exceeds 121° C. or about 250° F.

The following examples are provided for the purpose of illustration only and are not to be understood to limit the scope of the present invention.

EXAMPLE 1

An aqueous dyeing admixture having the following composition was prepared:

| Component | Concentration (grams per liter) |
|---|---|
| Para-chloro ortho-benzyl phenol | 5 |
| Methylene chloride | 100 |
| Antifoam NS<br>An antifoaming agent sold by Chemical Processing of Georgia | 2.5 |
| Latyl Yellow 3G - 50% paste (Disperse Yellow 54) | 4.10 |
| Latyl Orange NST Powder (Disperse Orange 25) | 1.77 |
| Latyl Cerise NSN - 100% paste (Disperse Red 60) | 2.76 |
| Resolin Blue FBL - 50% paste (Disperse Blue 56) | 0.25 |

The pH of the dyeing admixture was adjusted to 4.5 by the addition of 1.5 grams per liter of citric acid. The viscosity of the admixture was adjusted to 560 cp. by the addition of 400 grams per liter of a natural thickener containing guar gum which is sold by Celanese as Celcagum V60 VDM (1%).

The dyeing admixture was jet injected into the pile of a carpet having a pile of Type 825 false twist texturized polyester. The amount injected was between 250% and 300% of the dry weight of the carpet. After injection, the carpet was steamed for 8 minutes, rinsed and dried. The pile of the carpet was shown to be dyed in a dark brown shade with good penetration of the dyestuff into the fibers of the pile.

EXAMPLE 2

As a control, the procedure of Example 1 was repeated except that the methylene chloride was deleted from the dyeing admixture. The pH of the dyeing admixture was adjusted to 4.5 by the addition of citric acid. The viscosity was adjusted to 560 cp by the addition of 40.0 grams per liter of Celcagum V60-VDM (1%). After drying, the carpet was shown to be dyed a light shade of brown and the penetration of the dyestuff into the fibers was poor.

EXAMPLE 3

As another control, the procedure of Example 1 was repeated except that the para-chloro ortho benzyl phenol was deleted from the dyeing admixture. The pH of the dyeing admixture was again adjusted to 4.5 and the viscosity was adjusted to 560 cp. After drying, the carpet was shown to be dyed a light shade of brown slightly lighter than Example 2 and the penetration of the dyestuff into the fibers was poor.

EXAMPLE 4

The procedure of Example 3 was repeated except that the amount of para-chloro ortho benzyl phenol was increased to 10 grams per liter. The pH was adjusted to 4.1 and the viscosity was adjusted to 184 cp. In spite of the fact that the steaming time was increased to 15 minutes, upon drying the carpet was still shown to be dyed only a light shade of orange brown and the penetration of the dyestuff into the fibers was again poor. The depth of color obtained by the carpet in Example 4 was slightly darker than either of Examples 2 or 3 but still inferior to that obtained in Example 1.

The above Examples 1 through 4 indicate that unexpected and greatly improved results are obtained by using para-chloro ortho benzyl phenol with the methylene chloride as a carrier. It is also shown that synergistic action is obtained since the combination provides greatly improved results over either of the components separately even when the amount of the para-chloro ortho benzyl phenol is increased. The following examples are provided to further illustrate the breadth of the invention.

EXAMPLE 5

The procedure used was the same as Example 1 except that the following dyestuffs were used:

| Component | Concentration (grams per liter) |
|---|---|
| Latyl Yellow 3G - 50% paste (Disperse Yellow 54) | 2.88 |
| Latyl Cerise NSN - 100% paste (Disperse Red 60) | 0.03 |
| Latyl Blue BGA - 50% paste (Disperse Blue 60) | 15.72 |

After drying, the carpet was shown to be dyed a dark green shade with good penetration of the dyestuff into the fibers.

EXAMPLE 6

The procedure used was the same as Example 1 except that the following dyestuffs were used:

| Component | Concentration (grams per liter) |
|---|---|
| Latyl Orange NST - poweder (Disperse Orange 25) | 0.82 |
| Latyl Cerise NSN - 100% paste (Disperse Red 60) | 12.00 |
| Resolin Blue FBL - 50% paste (Disperse Blue 56) | 0.12 |

After drying, the carpet was shown to be dyed a deep, bright red with good penetration of the dyestuff into the fibers.

EXAMPLE 7

The procedure used was the same as Example 1 except that 15 grams per liter of a mixture of trichlorobenzene isomers were substituted for the para-chloro ortho benzyl phenol. The predominant isomer was 1,2,4 trichlorobenzene but others were present. After drying, the shade of the carpet was virtually indistinguishable from the dark shade of brown of Example 1. Penetration of the dyestuff into the fibers was good.

EXAMPLE 8

The procedure used was the same as Example 1 except that 15 grams per liter of methyl benzoate were substituted for the para-chloro orthobenzyl phenol. After drying, the shade of the carpet was virtually indistinguishable from the dark shade of brown of Example 1. The penetration of the dyestuff into the fibers was good.

EXAMPLE 9

The procedure used was the same as Example 1 except that butyl benzoate was substituted for the para-chloro ortho-benzol phenol. After drying, the carpet was shown to be dyed a lighter shade of the dark brown of Example 1 and was even lighter than Example 2. It was most comparable to Example 4 and the penetration of the dyestuff into the fibers was fair.

EXAMPLE 10

The procedure of Example 1 was repeated except that 100 grams per liter of 1,2 dichloroethane were substituted for the methylene chloride. The pH was adjusted to 3.7 and the viscosity was adjusted to 200 cp. After drying, the carpet was shown to be dyed a dark shade of brown slightly lighter than the shade of Example 1 but still far darker than any of Examples 2, 3 or 4. The penetration of the dyestuff into the fibers was good.

EXAMPLE 11

The procedure of Example 1 was again repeated except that 100 grams per liter of 1,1,1 trichloroethane were substituted for the methylene chloride. The pH was adjusted to 3.7 and the viscosity was adjusted to 200. After drying, the carpet was shown to be dyed a light shade of the dark brown of Example 1. The shade was lighter than that of Example 10 but still slightly darker than any of Examples 2, 3 or 4. The penetration of the dyestuff into the fibers was poor.

EXAMPLE 12

The procedure of Example 1 was again repeated except that 5 grams per liter of biphenyl were substituted for the para-chloro ortho-benzyl phenol. After drying, the carpet was shown to be dyed virtually the same dark shade of brown as Example 1. The penetration of the dyestuff into the fibers was good.

EXAMPLE 13

The procedure was again repeated except that 100 grams per liter of chloroform were substituted for the methylene chloride. The viscosity was adjusted to 200 centipoise and the pH was 3.7. After drying, the carpet was shown to be dyed the same dark shade of brown as Example 1. The penetration of the dyestuff into the fibers was slightly inferior to that of Example 1 but still good.

EXAMPLE 14

The procedure of Example 1 was again repeated except that 100 grams per liter of dimethylsulfoxide was substituted for the methylene chloride. The viscosity was adjusted to 160cp and the pH was adjusted to 3.8. After drying, the carpet was shown to be dyed a very light shade of brown lighter than any of Examples 2, 3 or 4. The penetration of the dyestuff into the fibers was very poor.

EXAMPLE 15

The procedure of Example 14 was repeated except that 100 grams of dimethyl formamide was substituted for the dimethyl sulfoxide. Upon dyeing, the carpet was shown to be dyed approximately the same shade of light brown as Example 14. The penetration of the dyestuff into the fibers was very poor.

EXAMPLE 16

The procedure of Example 1 was again repeated except that 5 grams per liter of methyl naphthalene were substituted for the para-chloro ortho-benzyl phenol. Upon drying, the carpet was shown to be dyed a lighter shade of the dark brown of Example 1 which was very close in shade to the shade of Example 10. The penetration of the dyestuff into the fibers was good.

EXAMPLE 17

The procedure of Example 1 was again repeated except that 100 grams per liter of perchloroethylene were substituted for the methylene chloride. After drying, the carpet was shown to be dyed a light brown with poor penetration of the dyestuff into the fibers.

The above Examples 5–17 illustrate that broad variations in the aromatic carrier are permissible while still yielding improved results. They also illustrate that dramatically improved results are obtained when the halogenated hydrocarbon is chosen from the group consisting of methylene chloride chloroform and 1,2 dichloroethane and the aromatic carrier is chosen from the group consisting of para-chloro ortho-benzyl phenol, biphenyl, trichlorobenzene, methylbenzoate and methyl naphthalene. Since dimethyl sulfoxide and dimethyl formamide are both known swelling agents and since they provide no significant advantages, it is shown that not all swelling agents for polyester will be effective but that only certain halogenated hydrocarbon solvents are effective and not all halogenated hydrocarbon solvents provide the dramatic improvement since perchloroethylene and trichloroethane are not as effective as methylene chloride, chloroform and 1,2 dichloroethane when the dye is fixed by atmospheric steaming. The following Example 18 illustrates the application of the invention to package dyeing and illustrates that while butyl benzoate is relatively ineffective in injection dyeing of carpets, it provides dramatic benefits in package dyeing.

EXAMPLE 18

The package dye machine was filled with 374 pounds of polyester yarn, 1/150 denier, Type 56 false twist textured Dacron. The dyes used were:

| Component | Concentration (based on the dry weight of the yarn) |
|---|---|
| Terasil Brilliant Orange 2RL (Disperse Orange 56) | .387% |
| Palanil Brilliant Pink REL (Disperse Red 91) | .424% |
| The package dye machine was filled with water at 80° F. The dyes were dispersed in water at 110° F with the following: | |
| Interquest TA (sequestering agent containing ethylene diame tetra acetic acid sold by Crompton et Knowles) | .50% |
| Acetic Acid | 1.0% |
| Solegal P | 0.50% |

Enough methylene chloride and butyl benzoate were mixed in a small tank so that upon addition to the dyeing chamber, the resulting concentration of the methylene chloride was 20% and the concentration of the butyl benzoate was 2% based on the dry weight of the yarn. The dyes were added to the dyeing chamber and were circulated through it for 20 minutes. The dye carriers were then added to the chamber and it was immediately pressurized. The temperature of the fluid in the chamber was raised 3° F. per minute until it reached 230° F., held there for 40 minutes, then cooled to 180° and the chamber depressurized. The yarn was rinsed with hot water at 160° F. for 5 minutes and standard scouring and lubricating procedures were applied to the yarn. The depth of color and the shade was virtually identical to that obtained in standard package dyeing procedure wherein temperatures of 280° F. are used.

EXAMPLE 19

The procedure of Example 18 was repeated except that the following dyestuffs were used:

| Component | Concentration (based on the dry weight of the yarn) |
|---|---|
| Samaron Yellow 6 GSL (Disperse Yellow 114) | .67% |
| Latyl Blue GFE (Disperse Blue 165) | 1.90% |
| Latyl Brilliant Blue BGA (Disperse Blue 60) | .40% |
| Latyl Cerise NSN (Disperse Red 60) | .24% |

After dyeing, the following results were obtained for standardized American Association of Textile Chemists and Colorists tests:

| | |
|---|---|
| Lightfastness - 20 hours | 4.5 |
| Sublimation 365° F - 30 seconds | 4.0 |
| Solvent bleed | 4.5 |
| Wash II-A | 4.5 |
| Acid Perspiration | 4.5 |
| Alkylene Perspiration | 4.5 |

EXAMPLE 20

To illustrate the application of this new procedure to acrylic yarns, a sample of Type 16 Acrilan yarn which is 100% acrylic was dyed using the method of the present invention. The Kier was filled with water at 90° F. and the following chemicals were added:

| Component | Concentration (based on the dry weight of the fabric) |
|---|---|
| Glaubers salt | 3.0% |
| Acetic Acid | .5% |
| Sequestrene 30A (Sequestrene 30A is an ethylenediaminetetracetic acid sequestering agent sold by Ciba-Geigy) | .2590 |
| Methylene chloride | 6.0% |
| Butyl benzoate | .6% |

The machine was pressurized and the temperature was raised to 160° F. at between 4 and 5 degrees per minute. The machine was depressurized and the following dyestuffs were added:

| Component | Concentration (based on the dry weight of the yarn) |
|---|---|
| Sevron Yellow L (Basic Yellow 13) | .126% |
| Astrazon Brilliant Red 4G (Basic Red 14) | .104% |
| Sevron Brilliant Red B (Basic Red 15) | .130% |
| Genacryl Blue 3G (Basic Blue 3) | .90% |

The machine was repressurized and run for 10 minutes at 160° F. The temperature was raised at 4 degrees per minute to 200° F. where it was held for 25 minutes. The machine was cooled to 180° F. and depressurized, cooled to 150° F. and the yarn was then rinsed. The total cycle time was 1 hour and 15 minutes.

After drying, the yarn was shown to be evenly dyed a deep shade of blue. The yarn was knitted into a fabric and the following results were obtained for American Association of Textile Chemists and Colorists tests:

| | |
|---|---|
| Lightfastness - 20 hours | 2.5 |
| Sublimation 365° F - 30 seconds | 4.5 |
| Wash II-A | 4.5 |
| Acid Perspiration | 4.5 |
| Alkaline Perspiration | 4.5 |
| Dry Crock | 4.5 |
| Wet Crock | 4.5 |

The following example is provided to illustrate the application of the present invention to jet dyeing.

EXAMPLE 21

A sample of doubleknit 100% polyester of single 150, false twist texturized Type 56 Dacron was dyed. The jet chamber was filled with water at 160° F. The following dyes and chemicals were added to the chamber:

| Component | Concentration (based on the dry weight of the fabric) |
|---|---|
| Samaron Yellow 6 GSL - 50% paste (Disperse Yellow 114) | .24 |
| Resolin Brilliant Red BLS - 50% paste (Disperse Red 159) | 3.70 |
| Sodyecron Scarlet 2R | 2.0 |

-continued

| Component | Concentration (based on the dry weight of the fabric) |
|---|---|
| (Disperse Red 194) | |
| Sequestrene 30A | .25 |
| Acetic Acid | .50 |
| Leveler 280 | 1.0 |

The bath was pressurized and the temperature was raised at the rate of 4 degrees per minute to 200° F. It was run 15 to 20 minutes at 200° F. at which time methylene chloride and methyl benzoate were introduced in the amounts of 15 grams per liter and 0.5 grams per liter, respectively. The temperature was then raised to 240° F. at 6 degrees per minute and held for 60 minutes. The jet machine was then cooled to 180° F., depressurized and the fabric was cooled, rinsed and dried. After drying, the fabric was shown to be dyed bright red and the following results were obtained for standardized American Association of Textile Chemists and Colorists tests:

| | |
|---|---|
| Lightfastness - 20 hours | 4.5 |
| Sublimation 365° F - 30 seconds | 4.5 |
| Wash II-A | 4.0 |
| Acid Perspiration | 4.5 |
| Solvent bleed | 4.5 |
| Wet Crock | 4.5 |
| Dry Crock | 4.5 |

EXAMPLE 22

The procedure and fabric used was the same as Example 21 except that the following dyestuffs were used:

| Component | Concentration (based on the dry weight of the fabric) |
|---|---|
| Resolin Yellow Brown - 50% paste (Disperse Orange 29) | 2.0 |
| Resolin Rubine BR - 100% paste (no color index no. - sold by Verona Chemicals) | 1.0 |
| Sodyecron Blue GBL - 50% paste (no color index no. - sold by Sodyeco) | 3.0 |
| Sodyecron Navy AR - 50% paste (no color index no. - sold by Sodyeco) | 1.0 |

After dyeing, the fabric was shown to be dyed deep black and the following results were obtained for standardized American Association of Textile Chemists and Colorists tests:

| | |
|---|---|
| Lightfastness - 20 hours | 4.5 |
| Sublimation 365° F - 30 seconds | 3.0 |
| Wash II-A | 3.5 to 4.0 |
| Acid Perspiration | 4.0 to 4.5 |
| Solvent bleed | 4.0 |
| Wet Crock | 4.5 |
| Dry Crock | 4.5 |

It is important to note that the fabric was dyed deep black using a 2-hour cycle in which the temperature never exceeded 240° F. A temperature of 280° F. for about 3 hours would have been required using the methods commonly known to the prior art.

The following example is provided to illustrate the application of the present invention to a fabric having an acrylic pile using jet injection dyeing.

EXAMPLE 23

A pile fabric having a polyester back and a 100% Type 16 Acrilan pile was dyed by injecting the following dyeing composition into the pile of the fabric:

| Component | Concentration (grams per liter) |
|---|---|
| Methylene chloride | 60 |
| Methyl benzoate | 15 |
| Product 12 - a thickener sold by Kelsan as a 1% solution | 400 |
| Levelin VKU - a wetting and foaming agent sold by Verona Dyestuffs | 5 |
| Antifoam 73 | 4 |
| Acetic Acid | 1.5 |
| Genacryl Yellow LR (Basic Yellow 28) | 1.36 |
| Intradene Fast Red GRL (Basic Red 46) | 1.20 |
| Sevron Blue 2G (Basic Blue 22) | 1.10 |

The pH of the resulting dyeing formulation was 4.5 and the viscosity was 800 cp.

This dyeing formulation was jet injected in a pattern into the pile of the fabric in an amount equal to approximately 250 to 300 percent of the weight of the fabric dyed, fabric was steamed for 10 minutes, rinsed and dried. The fabric was shown to be dyed a deep rust color and the detail of the pattern was good.

The following example illustrates the application of the present invention to piece dyeing of polyester-acrylic blends.

EXAMPLE 24

A sample of doubleknit fabric containing 50% Type 56 false twist texturized Dacron polyester and 50% Type 16 Acrilan spun yarn was jet dyed using the following procedure:

The jet chamber was filled with water at 80° F. The following chemicals were added:

| Component | Concentration (based on the dry weight of the fabric) |
|---|---|
| Sequestrene 30A | .25 |
| Acetic Acid | .50 |
| Leveler 280 | 1.00 |
| Methylene chloride | 15 grams per liter |
| Methyl benzoate | .5 grams per liter |
| Tanapal BP (a coercevating agent sold by Tanatex Chemicals) | 1.00 |

The following dyes were added to dye the polyester yarn:

| Component | Concentration (based on the dry weight of the fabric) |
|---|---|
| Samaron Yellow 6GSL (Disperse Yellow 114) | .10 |
| Resolin Brilliant Red BLS (Disperse Red 159) | 1.90 |
| Sodyecron Scarlet 2R (Disperse Red 194) | 1.0 |

The above dyes are disperse dyes of the type commonly used to dye polyester. To dye the acrylic yarn, Sevron Red 4G (Basic Red 14) was added in the amount of 1%. The temperature was raised to 240° F. at the rate of 4° F. per minute. It was held there for 30 minutes and then cooled. After rinsing and drying, the fabric was shown to be level dyed with both the acrylic and polyester yarns dyed to substantially the same depth of color.

EXAMPLE 25

The procedure of Example 19 was repeated except that perchloroethylene was substituted for the methylene chloride. The resulting yarn was knit into a fabric which yielded the following results when tested according to American Association of Textile Chemists and Colorists tests:

| | |
|---|---|
| Lightfastness - 20 hours | 4.5 |
| Sublimation 365° F - 30 seconds | 4.0 |
| Solvent bleed | 4.5 |
| Wash II-A | 4.5 |
| Acid Perspiration | 4.5 |
| Wet Crock | 4.5 |
| Dry Crock | 4.5 |

We claim:

1. A method of dyeing synthetic fibers, comprising the steps of:
   1. contacting the fibers with an aqueous dyeing admixture including from about 0.5% to 20% by weight based on the weight of said admixture of an organic dyeing formulation, said organic dyeing formulation including:
      a. from about 40% to 98% by weight based on the weight of said formulation of a halogenated hydrocarbon compound chosen from the group consisting of methylene chloride, chloroform, and 1,2 dichloroethane;
      b. from about 1% to 60% by weight based on the weight of said formulation of an aromatic carrier, said aromatic carrier being chosen from the group chosen from the group consisting of:
         i. Benzene derivatives having the structural formula

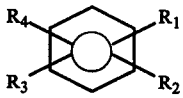

wherein each $R_1$, $R_2$, $R_3$ and $R_4$ individually is chosen from the group consisting of: a hydrogen, an alkyl group having 1–5 carbon atoms, a halogen, a hydroxyl group, a phenyl group, $$a-\overset{O}{\overset{\|}{C}}-O-C_nH_{2n+1}$$

group with n=1–5, a $$C_nH_{2n+1}-O-\overset{O}{\overset{\|}{C}}-CH_2-$$

group with n=1–3, a benzyl group, a phenethyl group, and an $-NO_x$ group with x=1–3, and at least one of $R_{1\text{-}4}$ is a moiety other than hydrogen;

ii. Naphthalene derivatives having the structural formula

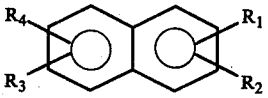

wherein $R_1$ - $R_4$ individually is chosen from the group consisting of: a hydrogen, an alkyl group having 1–5 carbon atoms, a halogen, a hydroxyl group, a phenyl group, $$-\overset{O}{\overset{\|}{C}}-O-C_nH_{2n+1}$$

group with n=1–5, a $$C_nH_{2n+1}-O-\overset{O}{\overset{\|}{C}}-CH_2-$$

group with n=1–5, a benzyl group, a phenethyl group and an $-NO_x$ group with x=1–3, and at least one of $R_{1\text{-}4}$ is a moiety other than hydrogen;

iii. mixtures of said aromatic compounds;
      c. an amount of dyestuff which is effective to dye said fibers to the desired depth of color;
      d. an effective amount of an emulsifier to disperse said halogenated hydrocarbon, said aromatic carrier and said dyestuff in said aqueous dyeing admixture;
   2. heating the fabric to an effective temperature for an effective amount of time to fix the dyestuff; and
   3. recovering the dyed fibers.

2. The method of claim 1 wherein the aromatic carrier is chosen from the group consisting of:
   methyl naphthalene;
   beta-naphthol;
   benzene derivatives having the structural formula

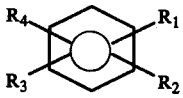

wherein each $R_1$, $R_2$, $R_3$ and $R_4$ individually is chosen from the group consisting of hydrogen, an alkyl group having from about 1 to about 5 carbon atoms, a halogen, a hydroxyl group, a phenyl group, a $$-\overset{O}{\overset{\|}{C}}-O-C_nH_{2n+1}$$

group with n=1–3, $$CH_2-\overset{O}{\overset{\|}{C}}-O-C_nH_{2n+1}$$

group with n=1–5, a benzyl group, a phenethyl group and an $-NO_x$ group with x=1–3 and at least one of $R_{1\text{-}4}$ is a moiety other than hydrogen; and mixtures of said compounds.

3. The method of claim 1 wherein the aromatic carrier is chosen from the group consisting of:

methyl naphthalene;

beta-naphthol;

benzene derivatives having the structural formula

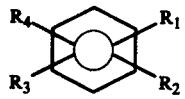

wherein each $R_1$, $R_2$, $R_3$ and $R_4$ individually is chosen from the group consisting of hydrogen, an alkyl group having from about 1 to about 5 carbon atoms, a halogen, a hydroxyl group, a phenyl group and a benzyl group, a phenethyl group and a $$-\overset{O}{\overset{\|}{C}}-O-C_nH_{2n+1}$$

group with n=1−3, wherein at least one of $R_{1\text{-}4}$ is a moiety other than hydrogen; and mixtures of said compounds.

4. The method of claim 1 wherein the aromatic carrier is chosen from the group consisting of methyl naphthalene, beta-naphthol, para-chloro ortho-benzyl phenol, methyl benzoate, 2,4,6 trichlorobenzene, 1,2,4 trichlorobenzene and mixtures thereof.

5. The method of claim 1 wherein the aromatic carrier is methyl benzoate and the aliphatic halogenated hydrocarbon solvent is methylene chloride.

6. A method of dyeing synthetic fibers, comprising the steps of:

1. contacting the fibers with an aqueous dyeing formulation in a pressurizeable chamber, said aqueous dyeing formulation including a dyestuff and an effective amount of an emulsifier to suspend said dyestuff in said aqueous dyeing admixture;
2. pressurizing said chamber to a first pressure and increasing the temperature of said aqueous dyeing admixture to a first temperature;
3. introducing from about 0.5% to about 20% based on the dry weight of the fibers of a mixture of an emulsifier, an aliphatic halogenated hydrocarbon and an aromatic carrier into said chamber, the quantity of said emulsifier being effective when combined with the emulsifier previously present to disperse said halogenated hydrocarbon and said aromatic carrier in said aqueous dyeing admixture, said aliphatic halogenated hydrocarbon boiling at said first pressure at a temperature which is less than said first temperature, said aliphatic halogenated hydrocarbon being chosen from the group consisting of perchloroethylene, methylene chloride, chloroform, 1,2 dichloroethane, and mixtures thereof and said aromatic carrier being chosen from a group consisting of:

benzene derivatives having the structural formula

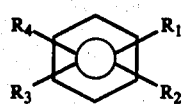

naphthalene derivatives having a structural formula

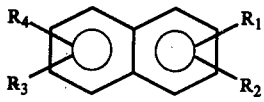

wherein each $R_1$, $R_2$, $R_3$ and $R_4$ individually is chosen from the group consisting of: a hydrogen, an alkyl group having from 1 to 5 carbon atoms, a halogen, a hydroxyl group, a phenyl group, a $$-\overset{O}{\overset{\|}{C}}-O-C_nH_{2n+1}$$

group with n=1−5, a $$-CH_2-\overset{O}{\overset{\|}{C}}-O-C_nH_{2n+1}$$

group with n=1−5, a benzyl group, a phenethyl group and an $-NO_x$ group with x=1−3, wherein at least one of $R_{1\text{-}4}$ is a moiety other than hydrogen; and mixtures of said aromatic compounds;

4. maintaining said aqueous dyeing admixture at a holding temperature which is greater than the boiling point of said aliphatic halogenated hydrocarbon compound at said pressure for an effective amount of time to dye said fibers;
5. cooling said dyeing admixture;
6. depressurizing said dyeing chamber; and
7. recovering said dyed fibers.

7. The method of claim 6 wherein said aromatic carrier chosen from the group consisting of:

methyl naphthalene;

beta-naphthol;

benzene derivatives having the structural formula

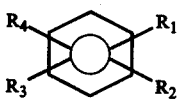

wherein each $R_1$, $R_2$, $R_3$ and $R_4$ individually is chosen from the group consisting of a hydrogen, an alkyl group having from 1 to 5 carbon atoms, a halogen, a hydroxyl group, a phenyl group, a $$-\overset{O}{\overset{\|}{C}}-O-C_nH_{2n+1}$$

group with n=1−5, a $$-CH_2-\overset{O}{\overset{\|}{C}}-O-C_nH_{2n+1}$$

group with n=1−5, a benzyl group, a phenethyl group and an $-NO_x$ group with x=1−3, wherein at least one of $R_{1\text{-}4}$ is a moiety other than hydrogen; and mixtures of said aromatic compounds.

8. The method of claim 6 wherein the aromatic carrier is chosen from the group consisting of:

beta naphthol;

methyl naphthalene;

benzene derivatives having the structure

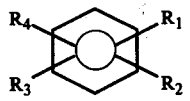

wherein each $R_1$, $R_2$, $R_3$ and $R_4$ individually is chosen from the group consisting of: a hydrogen, an alkyl group having from 1 to 5 carbon atoms, a halogen, a hydroxyl group, a phenyl group, a $$\overset{O}{\overset{\|}{C}}-O-C_nH_{2n+1}$$

group with n=1−5 and a benzyl group, wherein at least one of $R_{1\text{-}4}$ is a moiety other than hydrogen; and mixtures of said compounds.

9. The method of claim 6 wherein the aromatic carrier is chosen from the group consisting of methyl naphthalene, beta-naphthol, para-chloro ortho-benzyl phenol methyl benzoate, trichlorobenzene and biphenyl.

10. The method of claim 6 further comprising the steps of: recovering said aliphatic halogenated hydrocarbon compound.

11. The method of claim 6 wherein said synthetic fibers are polyester and wherein said holding temperature is between 200° F. and 260° F.

12. The method of claim 6 wherein said fibers are acrylic fibers and wherein said holding temperature is between 170° F. and 220° F.

13. A method of dyeing synthetic fabrics having a pile, comprising the steps of:

1. applying to the pile an aqueous dyeing admixture containing from about 1% to 65% by weight of an organic dyeing formulation, said organic dyeing formulation including:
   a. from about 40% to about 98% by weight based on the weight of said formulation of a halogenated hydrocarbon chosen from the group consisting of methylene chloride, chloroform and 1,2 dichloroethane;
   b. from about 1% to about 60% by weight based on the weight of said formulation of an aromatic carrier chosen from the group consisting of:
      benzene derivatives having the structural formula

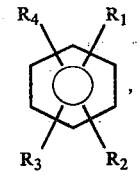

naphthalene derivatives having a structural formula

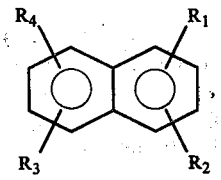

wherein each $R_1$, $R_2$, $R_3$ and $R_4$ individually is chosen from the group consisting of: a hydrogen, an alkyl group having from 1 to 5 carbon atoms, a halogen, a hydroxyl group, a phenyl group, a $$-\overset{O}{\overset{\|}{C}}-O-C_nH_{2n+1}$$

group with n=1 to 2, a $$-CH_2-\overset{O}{\overset{\|}{C}}-O-C_nH_{2n+1}$$

group with n=1−5, a benzyl group, a phenethyl group and an $-NO_x$ group with x=1−3; wherein at least one of $R_{1\text{-}4}$ is a moiety other than hydrogen, and mixtures of said aromatic compounds;

c. an effective amount of a dyestuff to dye said pile to the desired depth of color; and
   d. an effective amount of an emulsifier to disperse said halogenated hydrocarbon, said aromatic carrier and said dyestuff in said aqueous dyeing admixture;
2. setting the dye by steaming the pile for an effective amount of time to set said dyestuff;
3. rinsing the pile; and
4. drying the pile.

14. The method of claim 13 wherein said aromatic carrier is chosen from the group consisting of: para-chloro ortho-beyzyl phenol, methyl benzoate, 2,4,6 trichlorobenzene, 1,2,4 trichlorobenzene and mixtures thereof and wherein said halogenated hydrocarbon is methylene chloride.

15. The method of claim 13 wherein said fabric has a ployester pile and wherein said dyestuff is a disperse dyestuff.

16. The method of claim 15 wherein said aqueous dyeing formulation is applied by injection into the pile of the carpet or by padding onto the pile of the carpet.

17. The method of claim 16 wherein said aromatic carrier is chosen from the group consisting of: para-chloro ortho-benzyl phenol, methyl benzoate, 2,4,6 trichlorobenzene, 1,2,4 trichlorobenzene and mixtures thereof and wherein said halogenated hydrocarbon is methylene chloride.

* * * * *

UNITED STATES PATENT OFFICE

CERTIFICATE OF CORRECTION

Patent No. 4,131,424 Dated December 26, 1978

Inventor(s) George Cocoros et al.

It is certified that error appears in the above-identified patent and that said Letters Patent are hereby corrected as shown below:

Column 12, line 13, the figure ".2590" should be --.25--.

Column 15, line 40, after the word "group", first instance, delete the words --chosen from the group--.

Signed and Sealed this

*Twenty-fifth* Day of *November 1980*

[SEAL]

*Attest:*

SIDNEY A. DIAMOND

*Attesting Officer*

*Commissioner of Patents and Trademarks*